US009914891B2

(12) United States Patent
Bray et al.

(10) Patent No.: US 9,914,891 B2
(45) Date of Patent: Mar. 13, 2018

(54) PROCESS FOR MAXIMIZING DIESEL PRODUCTION USING A HEAVY HEAVY NAPHTHA STREAM

(71) Applicant: UOP LLC, Des Plaines, IL (US)

(72) Inventors: Jeffrey M. Bray, Wheaton, IL (US); James P. Glavin, Naperville, IL (US); Daniel J. Pintar, Hoffman Estates, IL (US); Xin X. Zhu, Long Grove, IL (US)

(73) Assignee: UOP LLC, Des Plaines, IL (US)

( * ) Notice: Subject to any disclaimer, the term of this patent is extended or adjusted under 35 U.S.C. 154(b) by 408 days.

(21) Appl. No.: 14/552,300

(22) Filed: Nov. 24, 2014

(65) Prior Publication Data

US 2016/0145510 A1 May 26, 2016

(51) Int. Cl.

| | |
|---|---|
| ***C10G 45/00*** | (2006.01) |
| ***C10L 1/08*** | (2006.01) |
| ***C10G 45/02*** | (2006.01) |
| ***C10G 7/00*** | (2006.01) |

(52) U.S. Cl.

CPC ..... *C10L 1/08* (2013.01); *C10G 7/00* (2013.01); *C10G 45/02* (2013.01); *C10G 2400/04* (2013.01); *C10L 2200/0415* (2013.01); *C10L 2200/0446* (2013.01); *C10L 2270/026* (2013.01); *C10L 2290/24* (2013.01)

(58) Field of Classification Search

CPC .. C10L 1/08; C10L 2290/24; C10L 2270/026; C10L 2200/0415; C10L 2200/0446; C10G 45/02; C10G 7/00; C10G 2400/04

See application file for complete search history.

(56) References Cited

U.S. PATENT DOCUMENTS

| | | | | |
|---|---|---|---|---|
| 3,513,217 | A | 5/1970 | Raymond | |
| 4,116,816 | A * | 9/1978 | Davis | C10G 65/16 208/209 |
| 4,645,585 | A | 2/1987 | White | |
| 6,540,023 | B2 | 4/2003 | Davis et al. | |
| 7,005,058 | B1 | 2/2006 | Towler | |
| 7,927,480 | B2 | 4/2011 | Podrebarac | |
| 2007/0095725 | A1 | 5/2007 | Podrebarac et al. | |
| 2008/0011643 | A1 * | 1/2008 | Lenglet | C10G 67/00 208/58 |
| 2012/0261308 | A1 | 10/2012 | Klein et al. | |
| 2013/0247453 | A1 | 9/2013 | Baustian et al. | |

OTHER PUBLICATIONS

Laredo et al., "Upgrading of low octane visbreaker naphtha by hydrotreating of SRGO/VN blends," ACS National Meeting Book of Abstracts (2005), vol. 230, 1 page.

Yuh et al., "Hydroprocessing: Hydrocracking: Question 27," NPRA Question and Answer Session on Refining and Petrochemical Technology (2008), 27-28.

Burgt et al., "The Shell middle distillate synthesis process," Erdoel Erdgas Kohle (1986), 102(7-8), 351-354.

* cited by examiner

*Primary Examiner* — Randy Boyer
*Assistant Examiner* — Juan Valencia

(57) ABSTRACT

Methods of maximizing diesel production are describes. The methods include providing a stream of heavy heavy naphtha; and blending the stream of heavy heavy naphtha with a diesel stream from the crude distillation zone to increase diesel production while maintaining the blended diesel stream within a specification for diesel. Various apparatus for maximizing diesel production are also described.

15 Claims, 4 Drawing Sheets

PROCESS FOR MAXIMIZING DIESEL PRODUCTION USING A HEAVY HEAVY NAPHTHA STREAM

BACKGROUND OF THE INVENTION

In some parts of the world, maximizing diesel production is the most important goal in petroleum refining.

One method of producing diesel is hydrocracking. Hydrocracking, may be designated as cracking under hydrogenation conditions such that the lower-boiling products of the cracking reactions are substantially more saturated than when hydrogen, or material supplying hydrogen, is not present. Although some hydrocracking processes are conducted thermally, the preferred processing technique involves the utilization of a catalytic composite possessing a high degree of hydrocracking activity. In virtually all hydrocracking processes, whether thermal or catalytic, controlled or selective cracking is desirable from the standpoint of producing an increased yield of liquid product having improved, advantageous physical and/or chemical characteristics.

In addition to the hydrocracking process, the diesel hydrotreating process is often necessary for making low sulfur diesel. Hydrotreating is a process wherein hydrogen gas is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. The cloud point of the hydrotreated product may also be reduced.

A conventional way to increase diesel production is to blend kerosene into diesel. However, increasing diesel production in this manner reduces the amount of kerosene (jet fuel) produced with little to no monetary advantage.

Therefore, there remains a need for processes for increasing the production of diesel without reducing the amount of kerosene produced.

SUMMARY OF THE INVENTION

One aspect of the present invention is method of maximizing diesel production. In one embodiment, the method includes providing a stream of heavy heavy naphtha; and blending the stream of heavy heavy naphtha with a diesel stream from the crude distillation zone to increase diesel production while maintaining the blended diesel stream within a specification for diesel.

In one embodiment, providing the stream of heavy heavy naphtha comprises: separating a crude oil feed into at least one stream in a crude distillation zone; hydrotreating the at least one stream from the crude distillation zone in a hydrotreating zone; and separating the at least one hydrotreated stream into at least the heavy heavy naphtha stream in a distillation zone.

In another embodiment, providing a stream of heavy heavy naphtha from comprises: separating a crude oil feed into at least two streams in a crude distillation zone, the two streams comprising a naphtha stream, and a stream comprising kerosene and diesel; hydrotreating the naphtha stream from the crude distillation zone in a naphtha hydrotreating zone; and separating the at least one hydrotreated naphtha stream into at least the heavy heavy naphtha stream in a distillation zone.

Another aspect of the invention is an apparatus for maximizing diesel production. In one embodiment, the apparatus includes a crude distillation zone having an inlet, an upper outlet, and a lower outlet; a naphtha hydrotreating zone having an inlet and an outlet, the inlet of the naphtha hydrotreating zone being in fluid communication with the upper outlet of the crude distillation zone; a first distillation zone having an inlet and a heavy heavy naphtha outlet, the inlet of the first distillation zone being in fluid communication with the outlet of the naphtha hydrotreating zone; a diesel hydrotreating zone having an inlet and an outlet, the inlet of the diesel hydrotreating zone being in fluid communication with the lower outlet of the crude distillation zone; and a second distillation zone having an inlet, a kerosene outlet, and a diesel outlet, the inlet of the second distillation zone being in fluid communication with the outlet of the diesel hydrotreating zone, and the diesel outlet being in fluid communication with the heavy heavy naphtha outlet of the first distillation zone.

In another embodiment, the apparatus includes a crude distillation zone having an inlet, and an outlet; a diesel hydrotreating zone having an inlet and an outlet, the inlet of the diesel hydrotreating zone being in fluid communication with the outlet of the crude distillation zone; and a first distillation zone having an inlet, a heavy heavy naphtha outlet, a kerosene outlet, and a diesel outlet, the inlet of the first distillation zone being in fluid communication with the outlet of the diesel hydrotreating zone, and the diesel outlet of the first distillation zone being in fluid communication with the heavy heavy naphtha outlet of the first distillation zone.

DETAILED DESCRIPTION OF THE INVENTION

Figure 1:
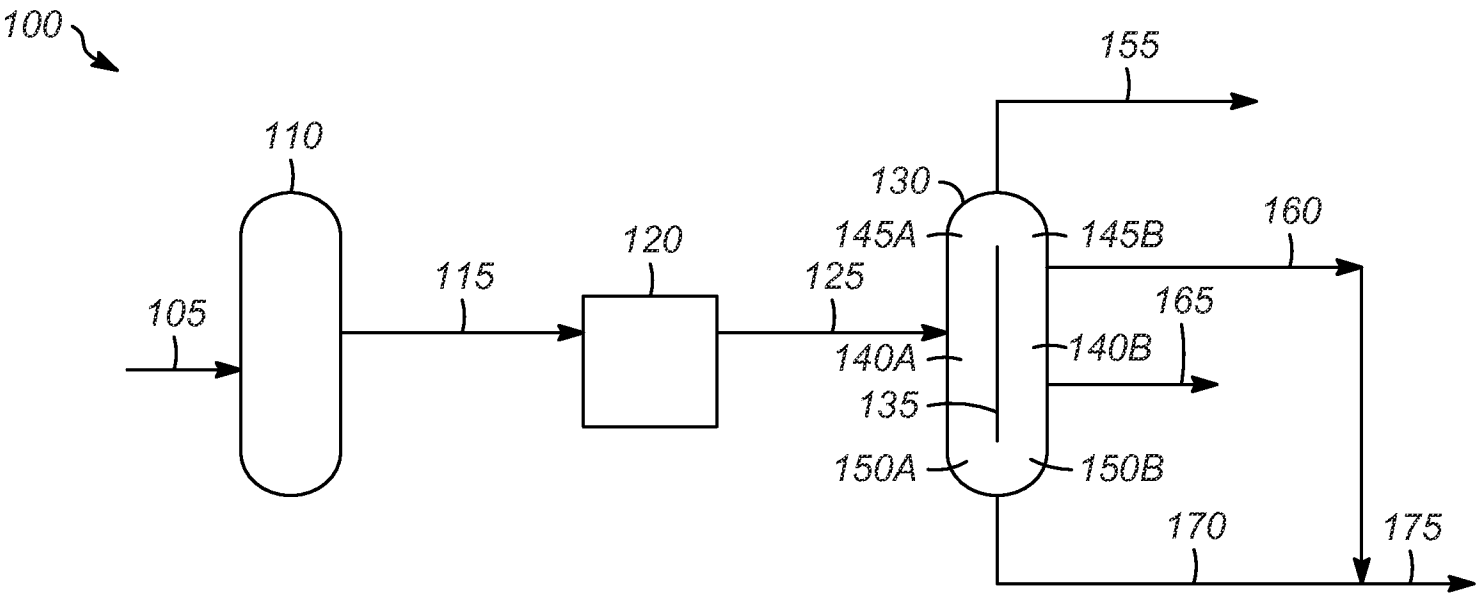
FIG. 1 illustrates one embodiment of a process of the present invention utilizing a dividing wall column.
Figure 2:
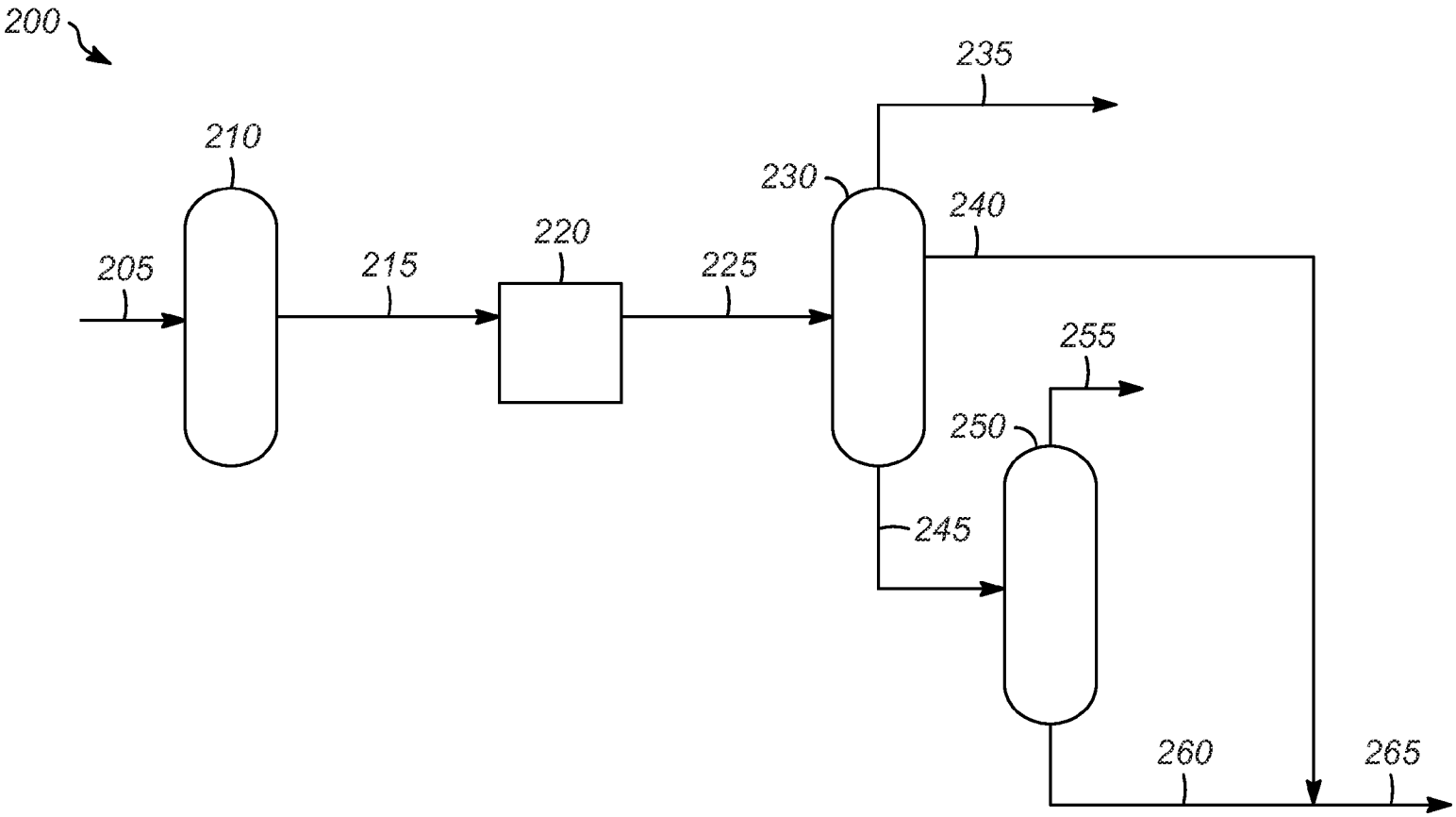
FIG. 2 illustrates another embodiment of a process of the present invention utilizing two columns.
Figure 3:
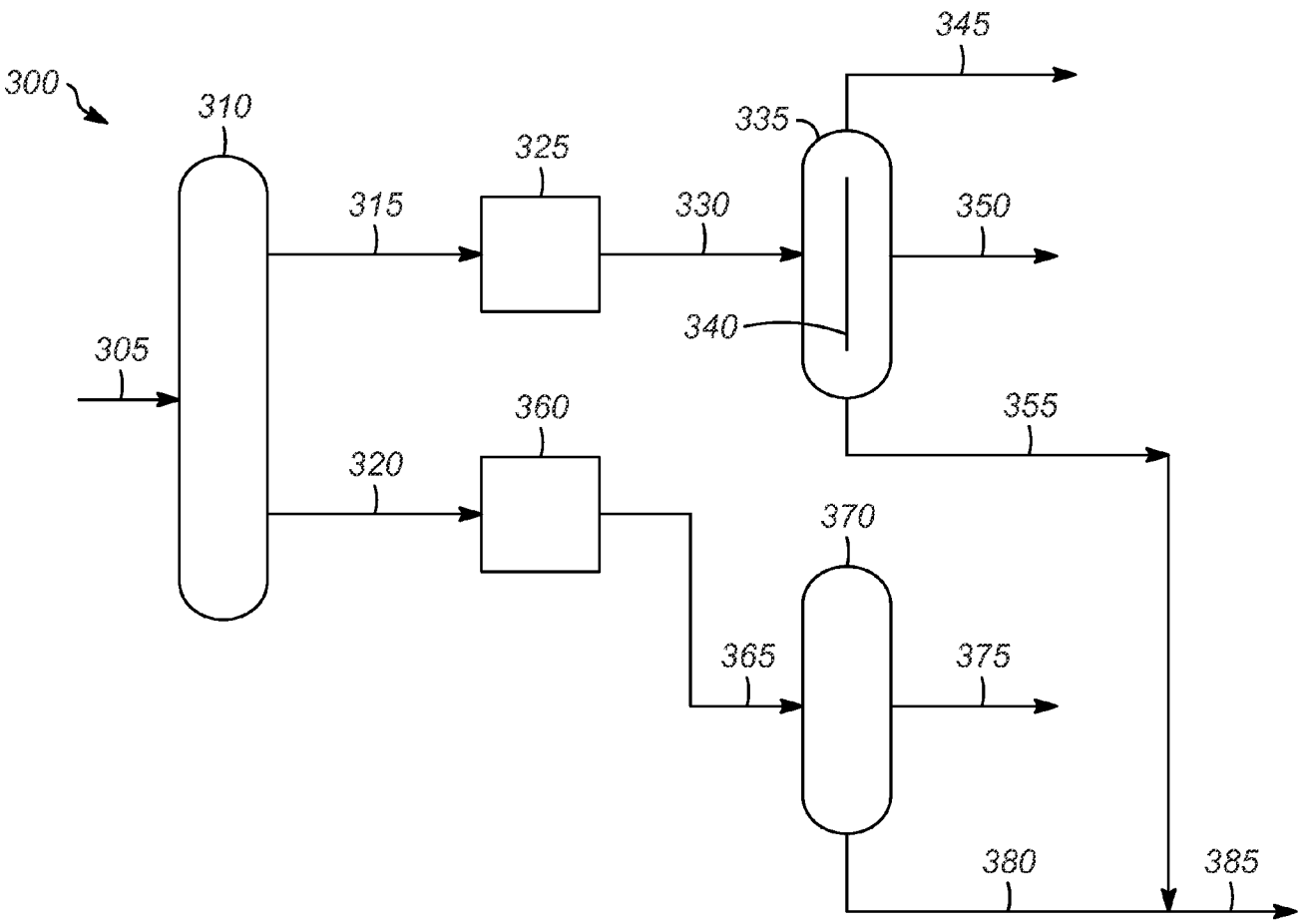
FIG. 3 illustrates another embodiment of a process of the present invention utilizing a dividing wall column.
Figure 4:
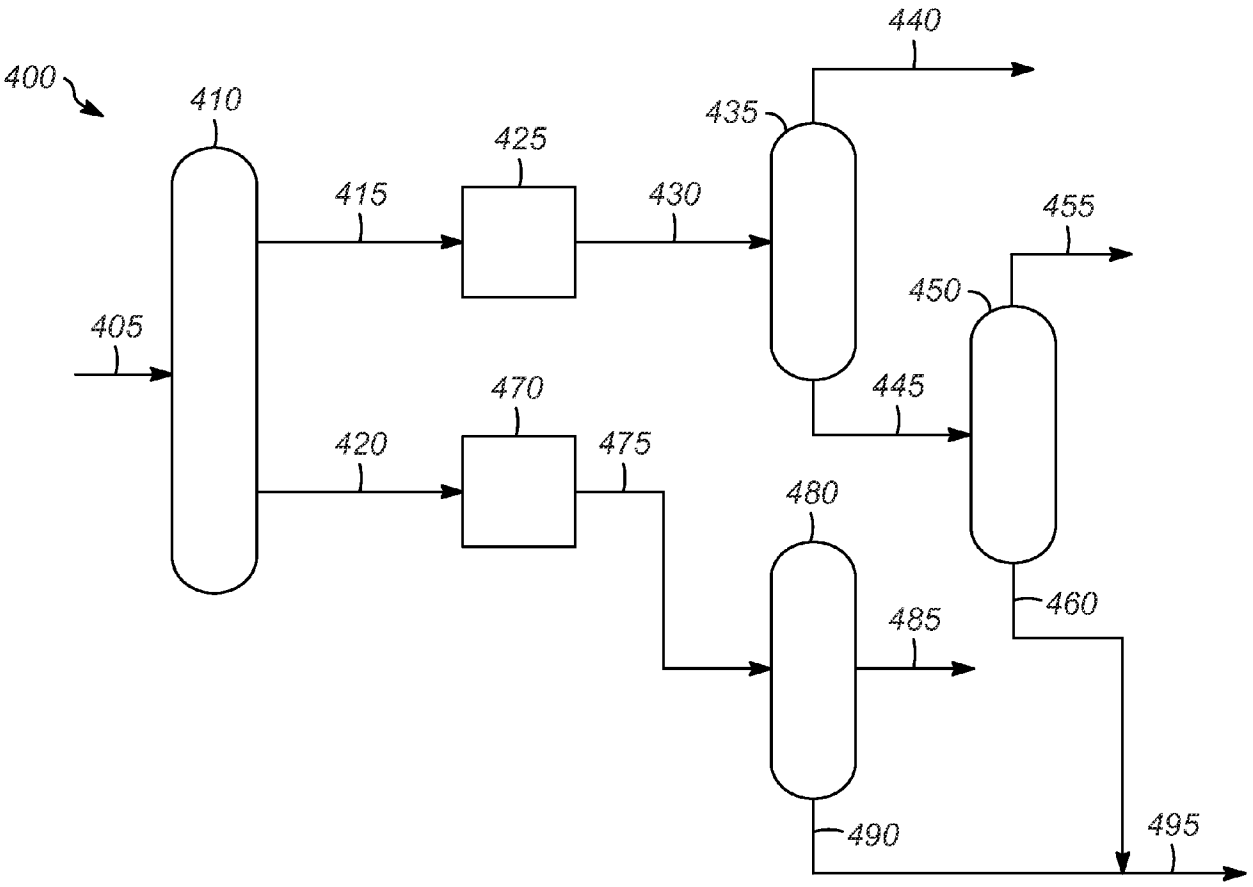
FIG. 4 illustrates another embodiment of a process of the present invention utilizing two columns.

The present invention meets this need by using a heavy heavy naphtha (HHN) stream as the diesel blending stock when the diesel is not at the flashpoint specification and the available kerosene is being used for production of other products, usually aviation jet fuel. The HHN stream contains hydrocarbons boiling in the range of between about 160° C. and about 177° C. using the True Boiling Point distillation method with T5 and T95 boiling points for of about 165° C. and 170° C. respectively. The HHN blending with diesel can be applied to straight run materials as shown in FIGS. 1-2, as well as hydrotreated naphtha as shown in FIGS. 3-4. The present invention allows the diesel production to be maximized by blending with the HHN without reducing the kerosene production while maintaining a property of the diesel and/or kerosene within the range specified by a fuel specification. The HHN cut accounts for about 5 to about 20% of the total naphtha, which could increase the diesel production increase by 3-4%. The amount of HHN added to the diesel is typically up to about 8 vol % of the blended diesel product.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "diesel" means hydrocarbons boiling in the range of between about 132° C. and about 400° C. using the True Boiling Point distillation method. T5 and T95 boiling points for diesel are about 140° C. and 380° C. respectively.

As used herein, the term "kerosene" means hydrocarbons boiling in the range of between about 132° C. and about 300° C. using the True Boiling Point distillation method. T5 and T95 boiling points for kerosene are about 140° C. and 290° C. respectively.

As used herein, the term "naphtha" means hydrocarbons boiling in the range of between about 50° C. and about 177° C. using the True Boiling Point distillation method. T5 and T95 boiling points for naphtha are about 55° C. and 170° C. respectively.

As used herein, the term "light naphtha" means hydrocarbons boiling in the range of between about 50° C. and about 65° C. using the True Boiling Point distillation method. T5 and T95 boiling points for light naphtha are about 55° C. and 60° C. respectively.

As used herein, the term "middle naphtha" means hydrocarbons boiling in the range of between about 65° C. and about 140° C. using the True Boiling Point distillation method. T5 and T95 boiling points for middle naphtha are about 72° C. and 130° C. respectively.

As used herein, the term "heavy naphtha" means hydrocarbons boiling in the range of between about 121° C. and about 160° C. using the True Boiling Point distillation method. T5 and T95 boiling points for heavy naphtha are about 127° C. and 155° C. respectively.

As used herein, the term "heavy heavy naphtha" means hydrocarbons boiling in the range of between about 160° C. and about 177° C. using the True Boiling Point distillation method. T5 and T95 boiling points for heavy heavy naphtha are about 165° C. and 170° C. respectively.

As used herein, the term "stream comprising naphtha, kerosene, and diesel" means hydrocarbons boiling in the range of between about 50° C. and about 400° C. using the True Boiling Point distillation method. T5 and T95 boiling points for this mixture are about 55° C. and 380° C. respectively.

As used herein, the term "stream comprising heavy heavy naphtha, kerosene, and diesel" means hydrocarbons boiling in the range of between about 160° C. and about 400° C. using the True Boiling Point distillation method. T5 and T95 boiling points for this mixture are about 165° C. and 380° C. respectively.

As used herein, the term "stream comprising kerosene, and diesel" means hydrocarbons boiling in the range of between about 132° C. and about 400° C. using the True Boiling Point distillation method. T5 and T95 boiling points for this mixture are about 140° C. and 380° C. respectively.

As used herein, the term "about," means within 10% of the value, or within 5%, or within 1%.

The first option is shown in FIGS. 1-2 which applies to a diesel hydrotreating unit. In this option, the HHN is obtained directly from the crude distillation unit. To achieve this, the cut point between the heavy naphtha and kerosene at the crude distillation unit is lowered so that the HHN is included in the kerosene/diesel draw. Both kerosene and straight run diesel are sent to the diesel hydrotreating zone. A divided wall distillation column (FIG. 1) or at least two distillation columns (FIG. 2) are used to generate the HHN which is then blended with diesel.

In the process 100 shown in FIG. 1, the crude oil feed 105 is separated in a crude distillation unit 110 to provide one or more fuel products. Stream 115 contains naphtha, kerosene, and diesel.

Stream 115 is sent to the diesel hydrotreating zone 120 along with a hydrogen stream. As discussed above, hydrotreating removes heteroatoms, such as sulfur, nitrogen and metals, from the hydrocarbon feedstock. Any diesel hydrotreating catalysts known in the art can be used, and the diesel hydrotreating conditions can be any suitable diesel hydrotreating conditions for the materials being hydrotreated.

Suitable diesel hydrotreating catalysts include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable diesel hydrotreating catalysts include zeolitic catalysts, as well as noble metal catalysts where the noble metal is selected from palladium and platinum. It is within the scope of the present invention that more than one type of diesel hydrotreating catalyst be used in the same diesel hydrotreating reactor. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

Suitable diesel hydrotreating reaction conditions include a temperature from about 290° C. (550° F.) to about 455° C. (850° F.), or about 316° C. (600° F.) to about 427° C. (800° F.), or about 343° C. (650° F.) to about 399° C. (750° F.), a pressure from about 4.1 MPa (600 psig) to about 13.1 MPa (1900 psig), or 6.2 MPa (900 psig) to about 13.1 MPa (1900 psig), a liquid hourly space velocity of the fresh hydrocarbonaceous feedstock from about 0.5 $hr^{-1}$ to about 4 $hr^{-1}$, or from about 1.5 $hr^{-1}$ to about 3.5 $hr^{-1}$, and a hydrogen rate of about 168 to about 1,011 $Nm^3/m^3$ oil (1,000-6,000 scf/bbl), or about 168 to about 674 $Nm^3/m^3$ oil (1,000-4,000 scf/bbl) for diesel feed, with a diesel hydrotreating catalyst or a combination of diesel hydrotreating catalysts.

The hydrotreated stream 125 is then sent to a divided wall distillation column 130 where it is separated into at least two streams.

The depiction of divided wall distillation column 130 is simplified as all the auxiliary operational components, such as controls, trays, condenser and reboiler, may be of conventional design. The divided wall distillation column 130 is distinguished from some traditional fractional columns by the presence of a vertical dividing wall 135 in a vertical mid portion of the divided wall distillation column 130, also referred to as the dividing wall portion of the divided wall distillation column 130.

This dividing wall 135 extends between opposing sides of the inner surface of the divided wall distillation column 130 and joins it in a substantially fluid tight seal. Thus, fluids cannot pass horizontally from one side of the divided wall distillation column 130 to the other and must instead travel either over or under the dividing wall 135. The dividing wall 135 divides the central portion of the divided wall distillation column 130 into two parallel fractionation zones or chambers 140A, 140B, which may be of different cross-section. Each chamber 140A, 140B and the rest of the divided wall distillation column 130 will contain conventional vapor liquid contacting equipment such as trays or packing. The type of tray and design details such as tray type, tray spacing and layout may vary within the divided wall distillation column 130 and between the two parallel chambers 140A, 140B of the dividing wall portion of the divided wall distillation column 130.

Additionally, as shown, each chamber 140A, 140B has an upper end 145A, 145B, and a lower end 150A, 150B. Since the dividing wall 135 is present only in the middle of the divided wall distillation column 130, the upper ends 145A, 145B of the two chambers 140A, 140B are in open communication. Additionally, the lower ends 150A, 150B of the two chambers 140A, 140B are likewise in open communication.

In this embodiment, the divided wall distillation column 130 separates the hydrotreated stream 125 into multiple streams. The overhead naphtha stream 145 has a boiling point in the range of about 50° C. to about 177° C. The naphtha can be recovered and/or further processed as needed.

An intermediate HHN stream 160 has a boiling point in the range of about 160° C. to about 177° C.

A second intermediate kerosene stream 165 has a boiling point in a range of about 132° C. to about 300° C. The kerosene can be recovered for use as jet fuel.

A bottoms diesel stream 170 has a boiling point in the range of about 132° C. and about 400° C. The HHN stream 160 is blended with the diesel stream 170 to form blended diesel stream 175. The amount of HHN that can be added to the diesel stream is determined by one or more properties in the diesel specification.

As will be appreciated by those of ordinary skill in the art, when separating hydrocarbons, there typically can be some crossover between the various fractions/streams during the separation processes and thus, the present invention is intended to accommodate the crossover amounts of compounds.

The specifications for different types of fuels are often expressed through acceptable ranges of chemical and physical requirements or properties of the fuel, such as flash point. For example, a fuel specification for diesel might require a flashpoint within the range of about 35° C. (95° F.) and about 60° C. (140° F.). The amount of HHN that could be added would be the amount that would allow the blended diesel to have a flashpoint in that range.

Fuel specifications can vary based on location. For example, different countries or groups of countries will often issue their own specification for a particular fuel. In some cases, different states or provinces within a country will issue special fuel specifications. Moreover, the fuel specifications can vary based on the time of the year; for example, there could be different fuel specifications for summer and winter. Blending of different components in order to meet the specification is quite common.

FIG. 2 presents a similar arrangement except that two distillation columns are provided instead of the divided wall column.

In this process 200, the crude oil feed 205 is sent to the crude distillation unit 210 where it is separated into various streams including stream 215 which contains the naphtha, kerosene, and diesel boiling range products. Stream 215 is hydrotreated in the diesel hydrotreating zone 220.

The hydrotreated stream 225 is sent to the first distillation column 230 where it is separated into overhead naphtha stream 235, HHN stream 240, and bottoms stream 245.

Bottoms stream 245 is sent to a second distillation column 250 where it is separated into kerosene stream 255, and diesel stream 260. The HHN stream 240 can be blended with diesel stream 260 to form blended diesel stream 265.

The second option is shown in FIGS. 3-4 which applies to a naphtha hydrotreating unit. The naphtha is separated into light naphtha, medium naphtha, and HHN, which is used to blend with the diesel.

In the process 300 shown in FIG. 3, the crude oil feed 305 is separated in the crude distillation unit 310 into at least two streams: a naphtha stream 315 having a boiling point in the range of about 50° C. to about 177° C., and stream 320 containing the kerosene and diesel boiling range products with a boiling point in the range of about 132° C. to about 400° C.

Naphtha stream 315 is sent along with a hydrogen stream to naphtha hydrotreating zone 325. Any naphtha hydrotreating catalysts known in the art can be used, and the naphtha hydrotreating conditions can be any suitable naphtha hydrotreating conditions for the materials being hydrotreated. Typically, the naphtha hydrotreating catalyst is composed of a first component of cobalt oxide or nickel oxide, along with a second component of molybdenum oxide or tungsten oxide, and a third component of an inorganic oxide support, which is typically a high purity alumina. Generally the cobalt oxide or nickel oxide component is in the range of about 1-about 5%, by weight, and the molybdenum oxide component is in the range of about 6-about 25%, by weight. The balance of the catalyst can be alumina so all components sum up to about 100%, by weight. One exemplary catalyst is disclosed in, e.g., U.S. Pat. No. 7,005,058. Typical naphtha hydrotreating conditions include an LHSV of about 0.5 $hr^{-1}$ to about 15 $hr^{-1}$, a pressure of about 690 kPa to about 6,900 kPa, and a hydrogen flow of about 20 to about 500 normal $m^3/m^3$ (about 100 to about 3000 SCFB).

The hydrotreated naphtha stream 330 is sent to divided wall distillation column 335 with dividing wall 340 where it is separated into a light naphtha stream 345 with a boiling point in the range of about 50° C. to about 65° C., a middle naphtha stream 350 with a boiling point in the range of about 65° C. to about 140° C., and a HHN stream 355 with a boiling point in the range of about 160° C. to about 177° C. Light naphtha stream 345 and middle naphtha stream 350 can be sent for further processing or sale.

Stream 320 with the kerosene and diesel products is sent with a hydrogen stream to diesel hydrotreating zone 360. The hydrotreated stream 365 is sent to distillation column 370 where it is separated into kerosene stream 375 with a boiling point in the range of about 132° C. to about 300° C. and diesel stream 380 with a boiling point of about 132° C. to about 400° C. Kerosene stream 375 can be recovered for use as jet fuel.

HHN stream 355 is blended with diesel stream 380 to form the blended diesel stream 385, with the amount of HHN added being determined by the diesel specifications.

A similar process 400 is shown in FIG. 4 except that two (or more) distillation columns are used for the naphtha separation instead of the divided wall distillation column.

The crude oil feed 405 is separated in the crude distillation unit 410 into at least two streams: a naphtha stream 415 having a boiling point in the range of 50° C. to 177° C., and stream 420 comprising kerosene and diesel with a boiling point in the range of about 132° C. to about 400° C.

Naphtha stream 415 is sent along with a hydrogen stream to naphtha hydrotreating zone 425. The hydrotreated naphtha stream 430 is sent to the first distillation column 435 where it is separated into a light naphtha stream 440 with a boiling point in the range of about 50° C. to about 65° C., and naphtha stream 445 with a boiling point in the range of about 50° C. to about 177° C.

Naphtha stream 445 is sent to a second distillation column 450 where it is separated into a middle naphtha stream 455 having a boiling point in the range of about 65° C. to about 140° C. and HHN stream 460 having a boiling point in the range of about 160° C. to about 177° C.

Stream 420 with the kerosene and diesel products is sent along with a hydrogen stream to diesel hydrotreating zone 470. The hydrotreated stream 475 is sent to distillation column 480 where it is separated into kerosene stream 485 with a boiling point in the range of about 132° C. to about 300° C. and diesel stream 490 with a boiling point between about 132° C. and about 400° C. Kerosene stream 485 can be recovered for use as jet fuel.

HHN stream 460 is blended with diesel stream 490 to form the blended diesel stream 495 with the amount of HHN added being determined by the diesel specifications.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of maximizing diesel production comprising:

separating a crude oil feed into at least one stream in a crude distillation zone;

hydrotreating the at least one stream from the crude distillation zone in a diesel hydrotreating zone;

separating the at least one hydrotreated stream into at least a stream of heavy heavy naphtha in a distillation zone, said stream of heavy heavy naphtha having a boiling point in the range of about 160° C. to about 177° C.; and blending the stream of heavy heavy naphtha with a diesel stream from a crude distillation zone to increase diesel production while maintaining the blended diesel stream within a specification for diesel.

2. The method of claim 1 wherein separating the crude oil feed into the at least one stream in the crude distillation zone comprises separating the crude oil feed into at least one stream comprising heavy heavy naphtha, kerosene, and diesel.

3. The method of claim 1 wherein separating the at least one hydrotreated stream into at least the heavy heavy naphtha stream in the distillation zone comprises separating the at least one hydrotreated stream into at least a naphtha stream, the heavy heavy naphtha stream, a kerosene stream, and the diesel stream.

4. The method of claim 3 wherein the kerosene stream has a flashpoint within a specification for jet fuel.

5. The method of claim 1 wherein the distillation zone comprises at least two distillation columns.

6. The method of claim 1 wherein the distillation zone comprises a divided wall distillation column.

7. The method of claim 6 wherein the diesel stream comprises a bottoms stream from the divided wall distillation column.

8. The method of claim 1 wherein providing a stream of heavy heavy naphtha comprises:

separating a crude oil feed into at least two streams in a crude distillation zone, the two streams comprising a naphtha stream, and a stream comprising kerosene and diesel;

hydrotreating the naphtha stream from the crude distillation zone in a naphtha hydrotreating zone;

separating the at least one hydrotreated naphtha stream into at least the heavy heavy naphtha stream in a distillation zone.

9. The method of claim 8 wherein separating the at least one hydrotreated naphtha stream into at least the heavy heavy naphtha stream in the distillation zone comprises separating the at least one hydrotreated stream into at least a light naphtha stream, a middle naphtha stream, and the heavy heavy naphtha stream.

10. The method of claim 8 wherein the distillation zone comprises at least two distillation columns.

11. The method of claim 8 wherein the distillation zone comprises a divided wall distillation column.

12. The method of claim 11 wherein the heavy heavy naphtha stream comprises a bottoms stream from the divided wall distillation column.

13. The method of claim 8 further comprising:

hydrotreating the stream comprising kerosene and diesel in a diesel hydrotreating zone;

separating the hydrotreated stream into at least the diesel stream and a kerosene stream in a second distillation zone.

14. The method of claim 1 further comprising:

hydrotreating at least one of the heavy heavy naphtha stream and the diesel stream under hydrotreating conditions before blending the heavy heavy naphtha stream with the diesel stream.

15. The method of claim 1 wherein the blended diesel stream comprises up to about 8 vol % of heavy heavy naphtha.

* * * * *